US005995879A

United States Patent [19]

Ginzel et al.

[11] Patent Number: 5,995,879

[45] Date of Patent: Nov. 30, 1999

[54] ENGINE COMMAND SELECTOR AND METHOD OF OPERATING SAME

[75] Inventors: Geoffrey D. Ginzel, Lafayette, Ind.; George W. Mattson, Lacon, Ill.

[73] Assignee: Caterpillar Inc., Peoria, Ill.

[21] Appl. No.: 08/788,008

[22] Filed: Jan. 24, 1997

[51] Int. Cl.[6] ..... F02D 45/00; F02D 11/10; F02P 9/00; F02P 1/00

[52] U.S. Cl. ..... 701/2; 701/93; 701/96; 701/110; 180/167; 123/335; 123/350; 123/333; 123/339.21; 123/406.12; 123/406.24; 123/406.26

[58] Field of Search ..... 701/2, 93, 96, 701/110; 123/335, 350, 333, 339.21, 406.12, 406.24, 406.26; 180/167

[56] References Cited

U.S. PATENT DOCUMENTS 3,967,603 7/1976 Habert ..... 123/335
4,074,665 2/1978 Patis ..... 123/335
4,733,644 3/1988 Staerzl ..... 123/352
4,914,597 4/1990 Moncelle et al. ..... 364/426.04
5,009,208 4/1991 Fiorenza II ..... 123/335

*Primary Examiner*—William A. Cuchlinski, Jr.
*Assistant Examiner*—Olga Hernandez
*Attorney, Agent, or Firm*—R. Carl Wilbur

[57] ABSTRACT

An engine speed command selector and method of selecting an engine speed command signal from two command signals includes a selector switch having a local and a remote position, a local low indicator, a local high indicator, a local mode indicator and a remote mode indicator; the engine speed command selector permits an operator to change between local and remote mode when a local engine speed command is within a predetermined tolerance of a remote engine speed command and the operator has moved the selector switch to the desired mode position.

12 Claims, 5 Drawing Sheets

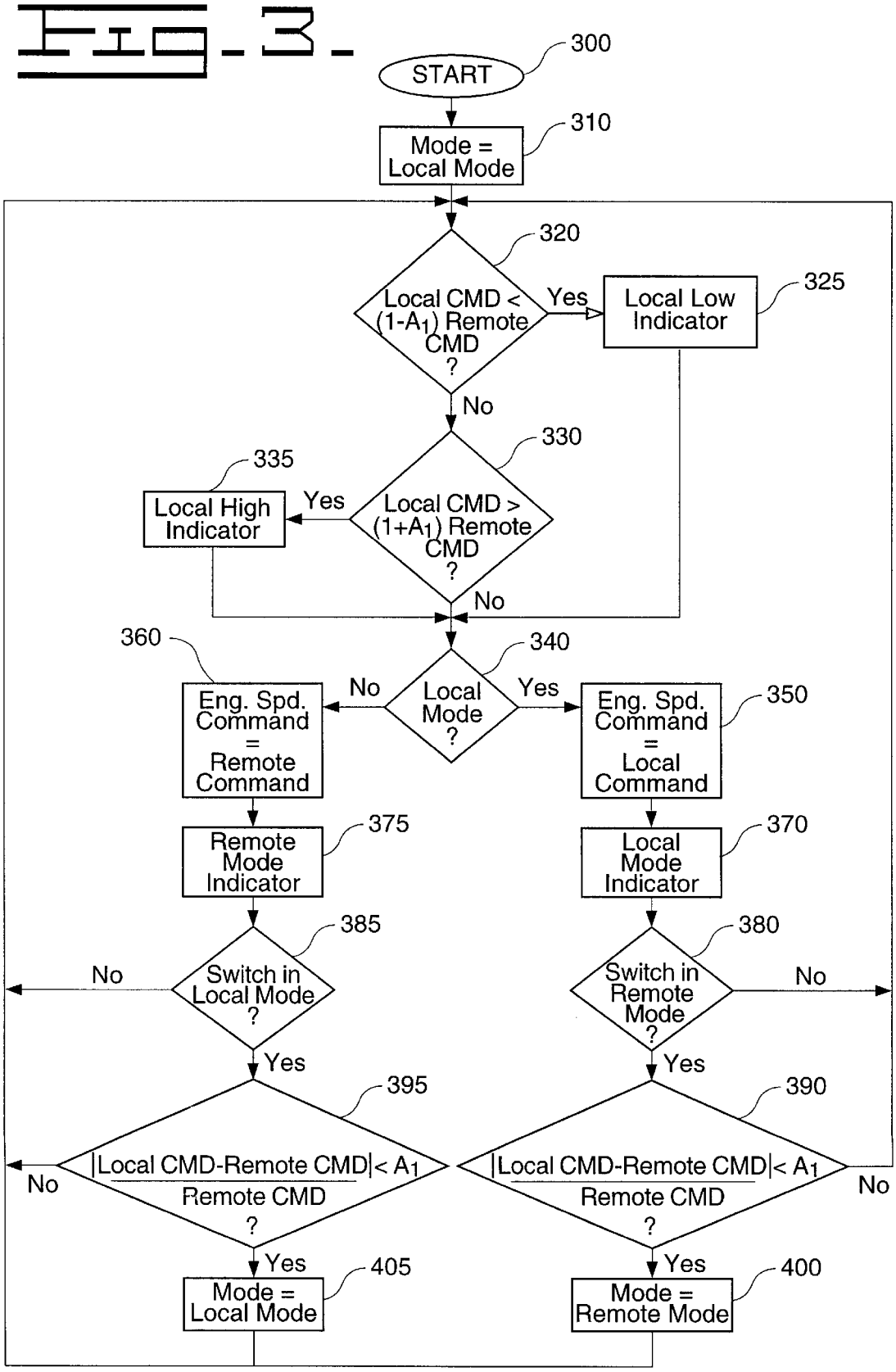
Fig-3-
START
300
Mode = Local Mode
310
Local CMD < (1-A1) Remote CMD ?
320
Yes
Local Low Indicator
325
No
Local CMD > (1+A1) Remote CMD ?
330
Yes
Local High Indicator
335
No
Local Mode ?
340
No
Yes
Eng. Spd. Command = Remote Command
360
Eng. Spd. Command = Local Command
350
Remote Mode Indicator
375
Local Mode Indicator
370
Switch in Local Mode ?
385
No
Yes
Switch in Remote Mode ?
380
No
Yes
|Local CMD-Remote CMD|< A1 / Remote CMD ?
395
No
Yes
|Local CMD-Remote CMD|< A1 / Remote CMD ?
390
No
Yes
Mode = Local Mode
405
Mode = Remote Mode
400

ENGINE COMMAND SELECTOR AND METHOD OF OPERATING SAME

TECHNICAL FIELD

The present invention relates to an electronic control for use with an internal combustion engine.

BACKGROUND ART

In certain applications it is desirable to permit an internal combustion engine to operate while being controlled from a remote location. For such applications, prior art systems have been developed that permit a desired engine speed command to be communicated to a remotely located engine via a telephone line or other communication link. The remotely generated desired engine speed command is then used by the engine controller to control the engine speed. Such remote control is sometimes used to control equipment in isolated locations in connection with compressors and generator sets, among other applications.

Even a remotely controlled engine, however, must sometimes be controlled locally. For example, if maintenance must be performed on the engine (or on equipment associated with the engine), the maintenance technician must be able to start and stop the engine and control the engine speed while performing the maintenance. Generally, in prior art controls that permit such remote operation, there is a toggle switch on the control panel that indicates whether the control is using a local desired engine speed command or a remote desired engine speed command to control the engine. When the maintenance technician wants local control he or she simply moves the toggle switch to the local position. The engine control then uses a local desired engine speed command developed through a potentiometer or other device to control engine speed. Then, when the technician has finished performing the maintenance, he or she simply moves the switch back to the remote position and the control then passes the remote engine speed command to the engine controller. While this technique may work satisfactorily in some situations there are significant drawbacks. For example, if the remote engine speed signal is significantly greater than the local engine speed signal, abruptly shifting from local to remote mode could result in an engine speed surge. Likewise, shifting from remote operation to local operation can produce a similar surge. Such surges are undesirable and could create stress on the engine.

It would be preferable to have a speed control system that permits two engine speed command signals to be selectively used and that minimizes engine speed surges when changing from one speed command to the other. Thus, one object of the present invention to permit an operator to switch from local to remote mode without creating undue engine speed surges.

SUMMARY OF THE INVENTION

In one aspect of the present invention a speed control device is provided for controlling which of two desired engine speed signals is used as an engine speed command for an electronically controlled internal combustion engine. The speed control device includes a first mode and a second mode wherein the speed control device produces a first engine speed command when in said first mode and a second engine speed command when in said second mode. The speed control device includes a selector switch that is positionable in a first and second position for selecting between the first mode and the second mode. The speed control permits the mode to be changed when the selector switch is moved to the other mode and the first command signal is within a predetermined tolerance of said second engine speed command.

Other aspects and advantages of the invention will be apparent upon reading the following specification in connection with the claims and the drawings.

BRIEF DESCRIPTION OF THE DRAWINGS

FIG. 3 shows a flowchart of the logic implemented in analog circuitry in a preferred embodiment of the invention.

DETAILED DESCRIPTION OF A PREFERRED EMBODIMENT OF THE INVENTION

The following is a detailed description of a preferred embodiment of the invention. This description does not alone define the scope of the present invention. To the contrary, the present invention includes all those other embodiments, modifications and equivalents of the device and method disclosed herein as may fall within the scope of the appended claims.

Figure 1:
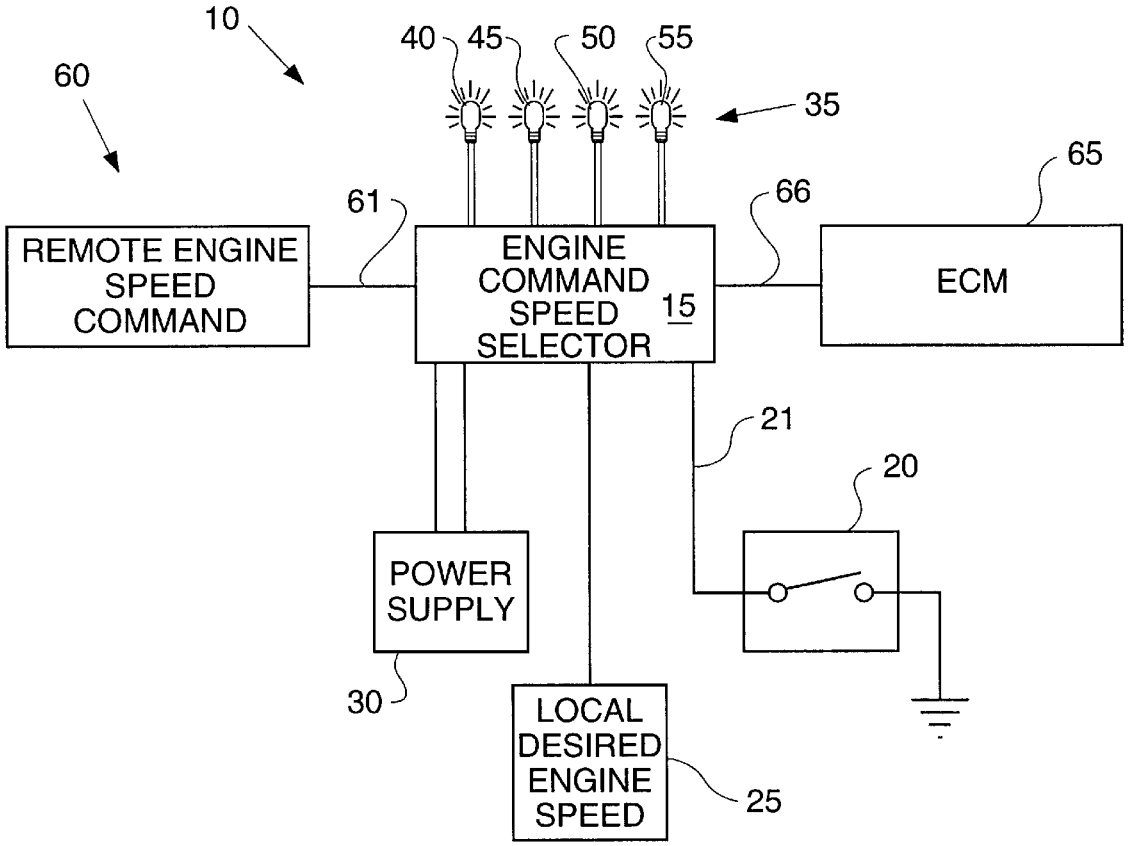
FIG. 1 shows a block diagram of a preferred embodiment of the speed control of the present invention.
Figure 4:
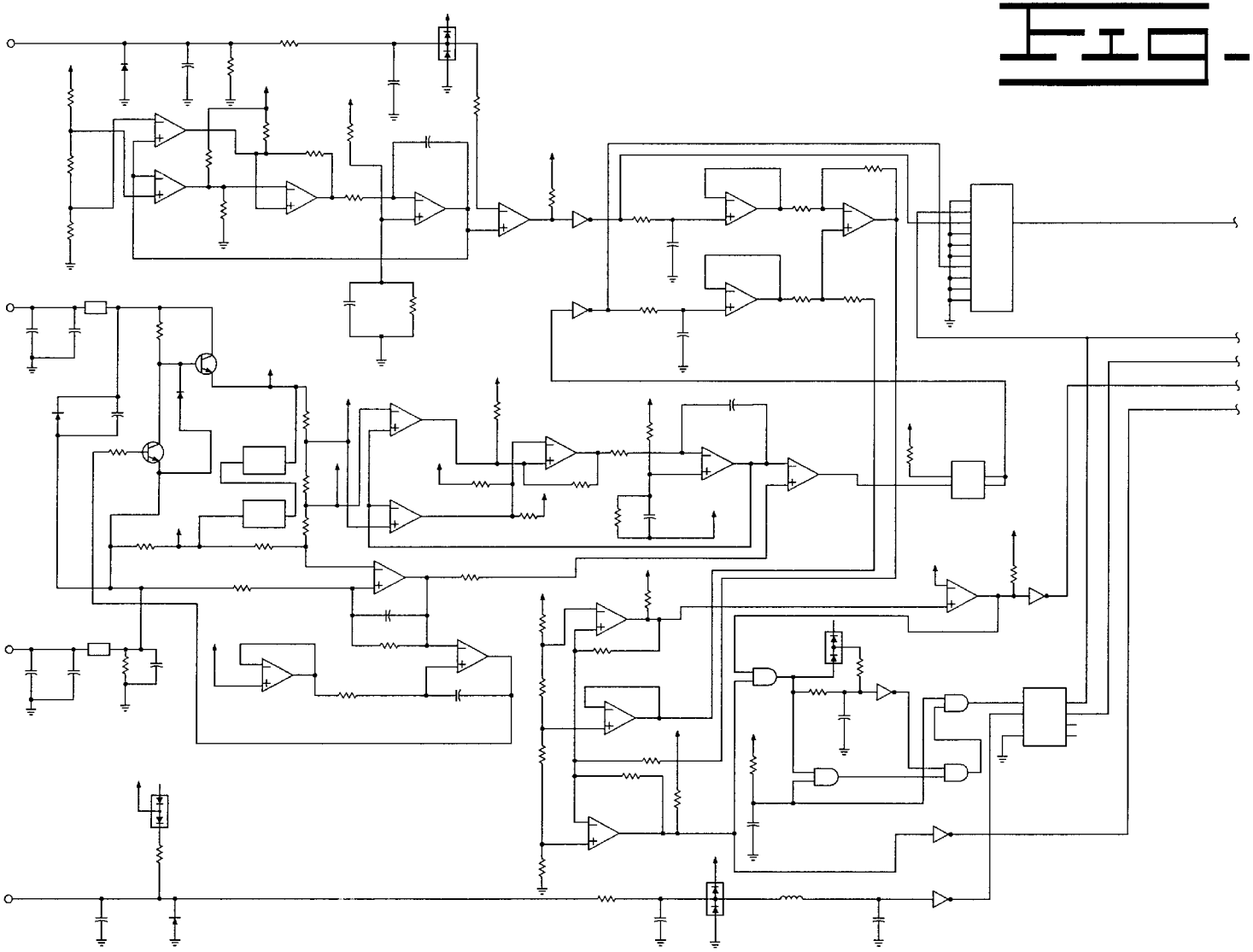
FIGS. 4 and 5 show a schematic diagram of the analog circuitry of the best mode embodiment of the speed control described herein.
Figure 5:
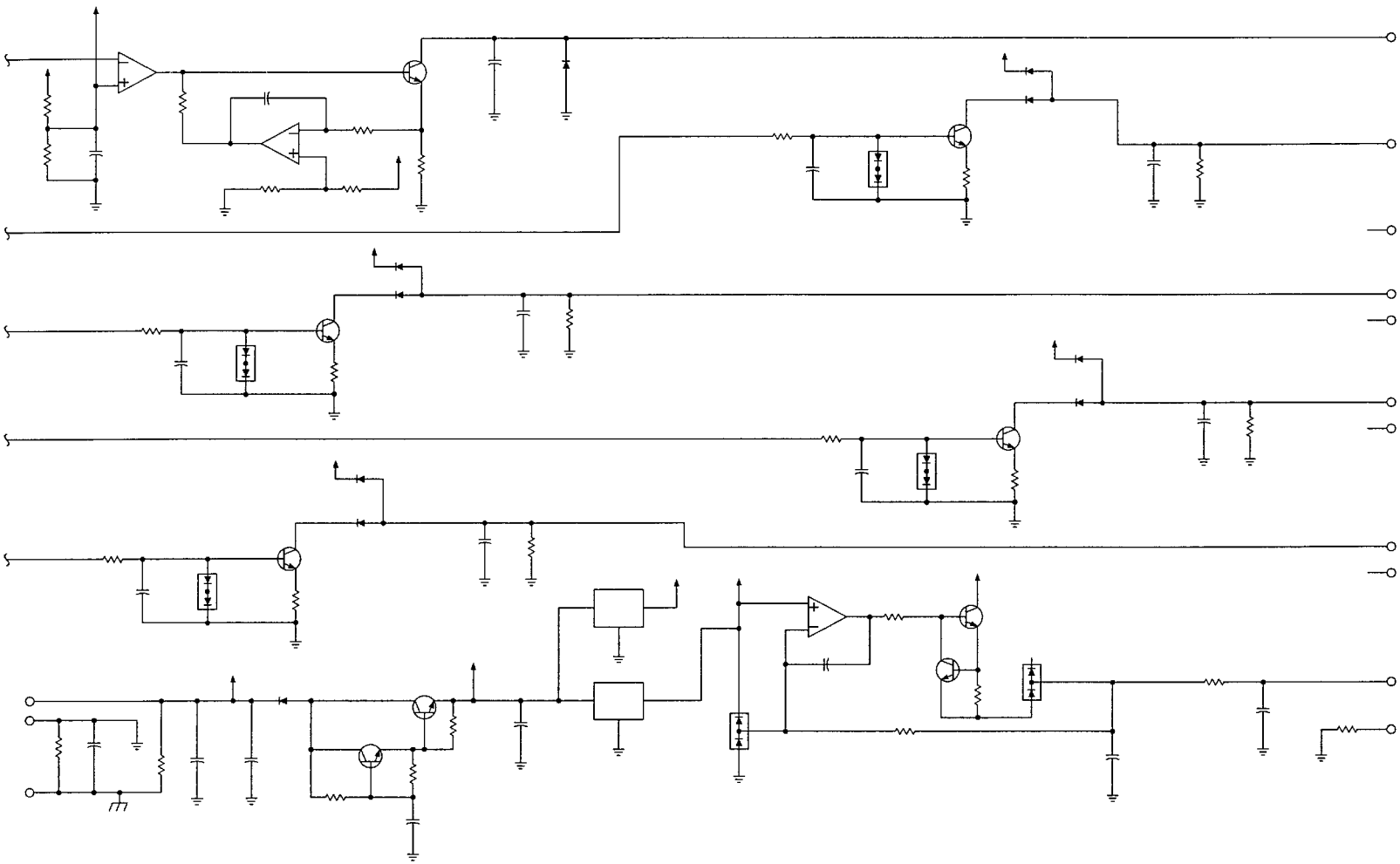

Turning first to FIG. 1, a block diagram of a preferred embodiment of the speed control 10 of the present invention is shown. Included in the speed control 10 is an engine speed command selector circuit 15, which in a preferred embodiment is implemented through discrete circuitry, as is more fully described below with respect to FIG. 3, and as is shown in FIGS. 4 and 5. Although the preferred embodiment uses discrete circuitry, other equivalent devices, such as a programmable logic device with appropriate software programming, could be readily and easily used in connection with the present invention.

Connected to the engine speed command selector circuit 15 is a selector switch 20 having an open and a closed position that produces a signal over connector 21. The signal over connector 21 is indicative of whether the switch is in a first or a second position, which in the preferred embodiment corresponds to a local and a remote position. Also connected to the engine speed command selector circuit 15 is a device 25 that produces a local engine speed command signal over connector 26. In a preferred embodiment the device 25 is a potentiometer. However, there are other equivalent devices that could be readily and easily substituted for a potentiometer and that produce a desired engine speed command signal. Use of such devices would fall within the scope of the present invention as defined by the appended claims. A power supply 30 is also connected to the engine speed command selector circuit 15 to power the electrical components and other devices.

As shown in FIG. 1, four indicators 35 are connected to the engine speed command selector circuit 15. In a preferred embodiment, the indicators 35 comprise lamps or other devices that illuminate thereby conveying information to the operator. Other types of indicators could be readily and easily used without deviating from the scope of the present invention as defined by the appended claims. In a preferred embodiment, the indicators 35 include a local low lamp 40, a local high lamp 45, a local mode lamp 50 and a remote mode lamp 55.

Also shown in FIG. 1, but not in themselves part of the present invention are a remote speed command device 60, which develops a remote engine speed command that is delivered to the engine speed command selector circuit 15 over a connector 61, and an electronic control module ("ECM") 65, which is associated with an internal combustion engine. The ECM 65 receives an engine speed command signal from the engine speed command selector circuit 15 on connector 66 and controls the engine speed according to a predetermined control strategy and the engine speed command. The engine speed command signal on connector 66 preferably is in the form of a pulse width modulated signal.

Figure 2:
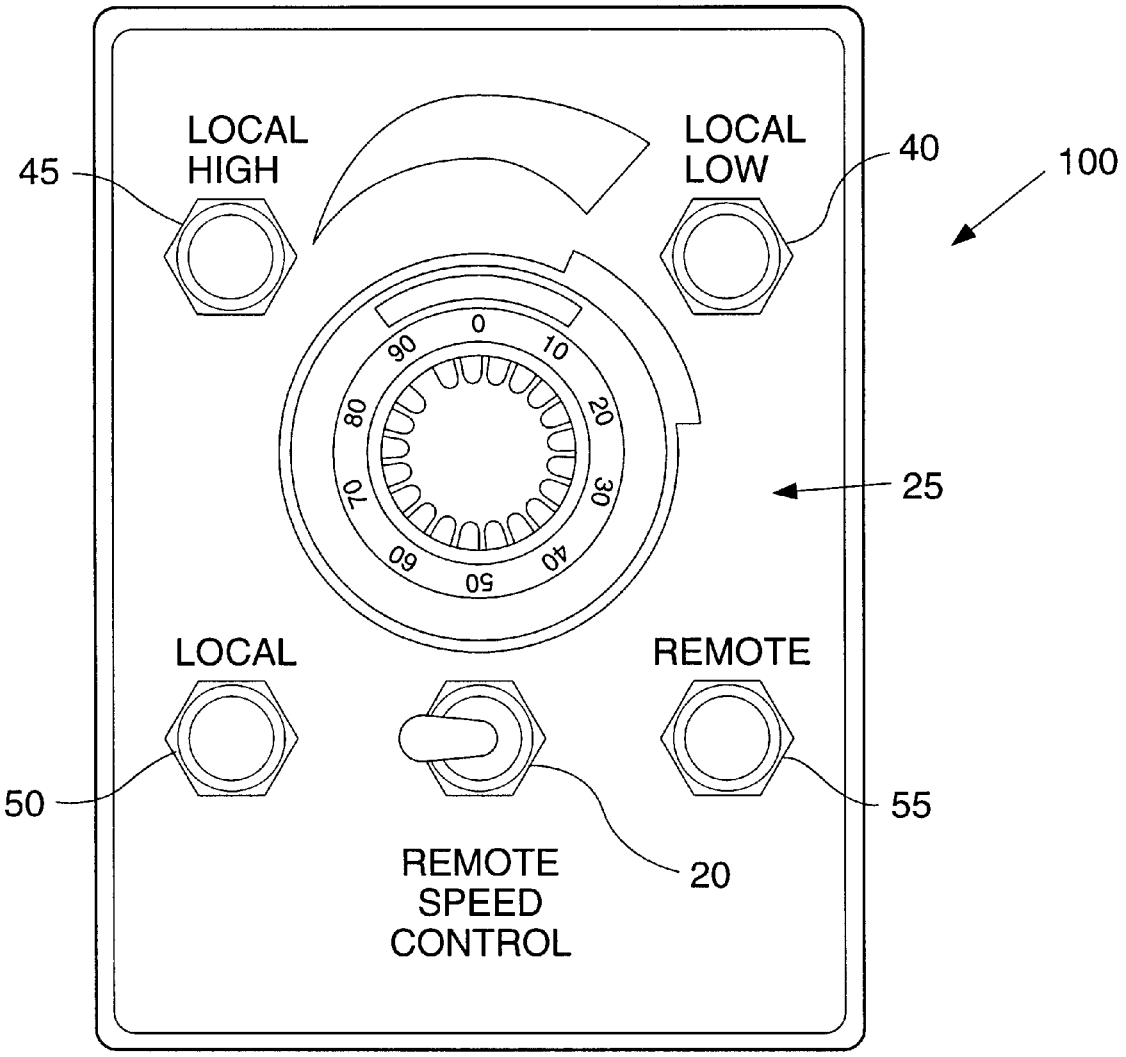
FIG. 2 shows a front view of an operator control panel of a preferred embodiment of the present invention.

Turning now to FIG. 2, an operator control panel 100 of a preferred embodiment of the invention is shown. As shown in FIG. 2, the operator control panel preferably includes the local low lamp 40, the local high lamp 45, the local mode lamp 50, the remote mode lamp 55, the device 25 that produces the local engine speed command signal over connector 26, and the selector switch 20. The operation of each of these components is described in full detail with reference to FIG. 3.

Turning now to FIG. 3, a flowchart is shown of a preferred logic implemented by the circuitry shown in FIGS. 4 and 5. Block 300 starts the flowchart, and logic flow proceeds to block 310. In block 310, the engine speed command selector circuit 15 is initialized, in part, by setting the current mode to LOCAL MODE. Logic flow then proceeds to block 320.

In block 320, the engine speed command selector circuit 15 compares the local engine speed command signal on connector 26 produced by device 25 to a multiple of the remote engine speed command signal on connector 61. That multiple is a function of a predetermined tolerance value A1, which in a preferred embodiment is 2.5%. Thus, as shown in block 320, if the local engine speed command signal on connector 26 is below (1+A1)% (in the preferred embodiment 97.5%) of the remote engine speed command signal on connector 61, then logic flow passes to block 325. In block 325, the engine speed command selector circuit 15 produces a signal that causes the local low lamp 40 to illuminate and then logic flow passes to block 340. If, on the other hand, in block 320 the local engine speed command signal on connector 26 is not below (1+A1)% (in the preferred embodiment 97.5%) of the remote engine speed command signal on connector 61, then logic flow passes to block 330.

In block 330, the engine speed command selector circuit 15 compares the local engine speed command signal on connector 26 produced by device 25 to a multiple of the remote engine speed command signal on connector 61. Again, that multiple is a function of a predetermined tolerance A1, which in a preferred embodiment is 2.5%. Thus, as shown in block 330, if the local engine speed command signal on connector 26 is above (1+A1)% (in the preferred embodiment 102.5%) of the remote engine speed command signal on connector 61, then logic flow passes to block 335. In block 335, the engine speed command selector circuit 15 produces a signal that causes the local high lamp 45 to illuminate and then logic flow passes to block 340. If, on the other hand, in block 320 the local engine speed command signal on connector 26 is not above (1+A1)% (in the preferred embodiment 102.5%) of the remote engine speed command signal on connector 61, then logic flow passes to block 340.

In block 340, the engine speed command selector circuit 15 checks to see whether the current mode is set to LOCAL MODE. If the current mode is LOCAL MODE then logic flow passes to block 350. Otherwise, if the current mode is REMOTE MODE then logic flow passes to block 360.

In block 350, the engine speed command selector circuit 15 selects the local engine speed command signal on connector 26 as the engine speed command signal to pass to the ECM 65 over connector 66. Logic flow then passes to block 370 where the engine speed command selector circuit 15 produces a signal that causes the local mode lamp 50 to illuminate, thereby indicating to the operator that the device 25 is controlling the engine speed. Logic flow then passes to block 380.

In block 380, the engine speed command selector circuit 15 checks the status of the selector switch 20, to determine whether the operator has moved the selector switch from the local position to the remote position, thereby indicating that the operator desires the remote engine speed command signal on connector 61 to be the active engine speed command passed to the ECM 65 on connector 66. If the selector switch has been moved to the remote position, then logic flow proceeds to 390. Otherwise, logic flow returns to block 320.

In block 390, the engine speed command selector circuit 15 checks to see whether the local engine speed command signal on connector 26 produced by device 25 is within a predetermined tolerance A1 (as noted above, A1 is about 2.5% in a preferred embodiment) of the remote engine speed command signal on connector 61. If it is, then logic flow proceeds to block 400 where the engine speed command selector circuit 15 changes the current mode from LOCAL MODE to REMOTE MODE and control returns to block 320. Otherwise, if in block 390 the local engine speed command signal on connector 26 produced by device 25 is not within a predetermined tolerance A1 of the remote engine speed command signal on connector 61 logic flow proceeds back to block 320 and the current mode remains LOCAL MODE. In this manner, the logic of the preferred embodiment prevents the operator from changing engine operation from LOCAL MODE to REMOTE MODE and thereby passing the remote engine speed command through to the ECM 65 if the difference between the local engine speed command and the remote engine speed command may cause an engine speed surge.

Returning now to block 360, the engine speed command selector circuit 15 has previously determined in block 340 that the current mode is REMOTE MODE. In block 360, the engine speed command selector circuit 15 produces the remote engine speed command on connector 61 as the engine speed command on line 66. The ECM 65 then controls the engine speed to the remote engine speed command. Logic flow then proceeds to block 375 where the engine speed command selector circuit 15 produces a signal that causes the remote mode lamp 55 to illuminate, thereby indicating to the operator that the remote speed command device 60 is controlling the engine speed. Logic flow then passes to block 385.

In block 385, the engine speed command selector circuit 15 checks the status of the selector switch 20 to see whether the operator has moved the selector switch from the remote position to the local position thereby indicating that he or she desires the local engine speed command signal on connector 26 to be the active engine speed command passed to the ECM 65 on connector 66. If the selector switch has been moved to the local position, then logic flow proceeds to 395. Otherwise, logic flow returns to block 320.

In block 395, the engine speed command selector circuit 15 checks to see whether the local engine speed command signal on connector 26 produced by device 25 is within a predetermined tolerance A1 (as noted above, A1 is about 2.5% in a preferred embodiment) of the remote engine speed command signal on connector 61. If it is, then logic flow proceeds to block 405 where the engine speed command selector circuit 15 changes the current mode from REMOTE MODE to LOCAL MODE and logic flow returns to block 320. Otherwise, if in block 395, the local engine speed command signal on connector 26 produced by device 25 is not within a predetermined tolerance A1 of the remote engine speed command signal on connector 61 logic flow proceeds back to block 320 and the current mode remains REMOTE MODE. In this manner, the logic of the preferred embodiment prevents the local engine speed command from being passed through to the ECM 65 if the difference between the local engine speed command and the remote engine speed command is great enough to cause an engine speed surge if the mode is changed.

By implementing the above logic in either discrete circuitry or in a software implementation, the preferred embodiment achieves the advantages and objects of the present invention. Returning to FIG. 2, practical operation of preferred embodiments will be described. In practice, if an operator wants to switch from REMOTE MODE to LOCAL MODE he must first look to see whether the local high lamp 45 or the local low lamp 40 is illuminated. The operator must then manipulate the device 25 to extinguish the lamp (if either is illuminated). For example, if the local low lamp 40 is illuminated, then the local engine speed command is less than the tolerance A1 below the remote engine speed command and therefore, the operator must manipulate the dial on the device 25 to increase the local engine speed command. Once the local engine speed command is within the tolerance A1 the lamp 40 will go out. The operator can then switch the selector switch to the local position and the engine speed is then controlled through the device 25.

Changing back to REMOTE from LOCAL MODE involves similar steps. The operator must manipulate the local engine speed command through use of the device 25 to extinguish both the local low lamp 40 and the local high lamp 45, then must switch the selector switch 20 to the remote position. The engine speed command selector circuit 15 will then change back to REMOTE MODE.

Turning now to FIG. 4 and 5, the discrete circuitry implementation of the logic of the flowchart of FIG. 3 is shown. Design and implementation of such circuitry from the detailed flowchart of FIG. 3 is a mere mechanical step for one skilled in the art. The ease of implementation is further enhanced by inclusion of FIGS. 4 and 5, and as a result can be achieved by a technician. Because the schematic diagrams of FIGS. 4 and 5 include standard electrical engineering symbols and those schematics are easily read and understood by those skilled in the art, they are not described further herein.

Attached hereto as Appendix A is a "Special Instruction" manual for the installation and operation of a commercial embodiment of the invention claimed herein. This manual provides further detailed description of certain aspects of an embodiment of the invention.

Although the preferred embodiment has been described in connection with a remote and a local engine speed command signal, it should be readily apparent that these terms are simply convenient labels for the two command signals in the context of this embodiment. Use of those labels should not be construed as requiring any geographical separation between the origins of those signals. To the contrary, the present invention encompasses a speed control that determines which of a first or a second engine speed command is passed to the engine controller where both the first and the second engine speed command are generated locally to the engine (or both are generated remotely). Thus, although the terms used herein refer to a remote and a local engine speed command, they are not intended to limit the scope of the invention.

We claim:

1. A speed command selector for use with an electronically controlled internal combustion engine, said speed command selector comprising:

an engine speed command selector circuit having a first mode and a second mode, said circuit being connected to an electronic control module of the electronically controlled engine;

an engine speed command selector switch having a local position and a remote position, said selector switch being connected to said engine speed command selector circuit;

a local engine speed command signal input to said engine speed command selector circuit;

a remote engine speed command signal connected to said remote engine speed selector circuit;

wherein said engine speed command selector circuit produces said local engine speed command signal as an output to said electronically controlled engine when said engine speed command selector circuit is in said local mode;

wherein said engine speed command selector circuit produces said remote engine speed command signal as an output to said electronically controlled engine when said engine speed command selector circuit is in said remote mode; and wherein said mode of said engine speed command selector circuit is changed from one mode to another by moving said engine speed command selector switch from one position to another when said first engine speed command signal is within a predetermined tolerance (A1) of said second engine speed command signal.

2. A speed command selector according to claim 1, wherein said mode of said engine speed command selector circuit cannot be changed from one mode to another by moving said engine speed command selector switch from one position to another when said first engine speed command signal is not within a predetermined tolerance (A1) of said second engine speed command signal.

3. A speed command selector according to claim 1, including a local low indicator connected to said engine speed command selector circuit, said local low indicator being illuminated when said local engine speed command is less than (1+A1) multiplied by the remote engine speed command.

4. A speed command selector according to claim 1, including a local high indicator connected to said engine speed command selector circuit, said local low indicator being illuminated when said local engine speed command is greater than (1+A1) multiplied by the remote engine speed command.

5. A method of selecting between a local and a remote engine speed command for use as an engine speed command for an electronic engine controller, said method comprising:

determining whether a selector switch has been moved from a remote mode position to a local mode position;

comparing a local engine speed command to a remote engine speed command; and producing said local engine speed command in response to said step of determining and said step of comparing.

6. The method according to claim 5, wherein said step of comparing includes determining whether said local engine speed command is within a predetermined tolerance (A1) of said remote engine speed command.

7. The method according to claim 6, including the steps of:

illuminating a first indicator in response to said local engine speed command being less than the product of (1−A1) multiplied by the remote engine speed command; and illuminating a second indicator in response to said local engine speed command being greater than the product of (1+A1) multiplied by the remote engine speed command.

8. The method according to claim 7, including the steps of:

monitoring the output of a local engine speed command device;

modifying the value of said local engine speed command in response to the output of said local engine speed command device;

extinguishing said first indicator in response to said step of modifying, when said local engine speed command becomes greater than the product of (1−A1) multiplied by the remote engine speed command; and extinguishing said second indicator in response to step of modifying, when said local engine speed command becomes less than the product of (1+A1) multiplied by the remote engine speed command.

9. A method of selecting between a local and a remote engine speed command for use as an engine speed command for an electronic engine controller, said method comprising:

determining whether a selector switch has been moved from a local mode position to a remote mode position;

comparing a local engine speed command to a remote engine speed command; and producing said remote engine speed command in response to said step of determining and said step of comparing.

10. The method according to claim 9, wherein said step of comparing includes determining whether said local engine speed command is within a predetermined tolerance (A1) of said remote engine speed command.

11. The method according to claim 10, including the steps of:

illuminating a first indicator in response to said local engine speed command being less than the product of (1−A1) multiplied by the remote engine speed command; and illuminating a second indicator in response to said local engine speed command being greater than the product of (1+A1) multiplied by the remote engine speed command.

12. The method according to claim 11, including the steps of:

monitoring the output of a local engine speed command device;

modifying the value of said local engine speed command in response to the output of said local engine speed command device;

extinguishing said first indicator in response to said step of modifying, when said local engine speed command becomes greater than the product of (1−A1) multiplied by the remote engine speed command; and extinguishing said second indicator in response to step of modifying, when said local engine speed command becomes less than the product of (1+A1) multiplied by the remote engine speed command.

* * * * *

UNITED STATES PATENT AND TRADEMARK OFFICE
CERTIFICATE OF CORRECTION

PATENT NO. : 5,995,879
DATED : November 30, 1999
INVENTOR(S) : Ginzel et al.

It is certified that error appears in the above-identified patent and that said Letters Patent is hereby corrected as shown below:

Column 6, line 53, delete "(1+A1)" and insert --(1-A1)--

Appendix A, consisting of 16 pages, was not included in the issued patent. Attach Appendix A to the end of the patent.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*

APPENDIX A 96-757

CATERPILLAR®

Special Instruction

Installation Of 132-5560 Remote Speed Control Kit 1915, 1900

G3600 ..... 3XF22-Up, 4WF18-Up, 1YG25-Up, 4CG24-Up

Introduction

This Special Instruction describes the procedures for installation and troubleshooting of 132-5560 Remote Speed Control Kit for G3600 Engines with the Engine Supervisory System (ESS) panel.

This Special Instruction contains installation, operations, and basic troubleshooting information. Read, study, and keep this information with the other product literature for your engine..

Whenever a question arises about this product or this Special Instruction, contact your Caterpillar dealer regarding the latest available information.

NOTICE

Do not perform any procedure outlined in this Special Instruction or order any parts until you have read and understood this information.

Reference

G3600 Engine Troubleshooting, SENR6510.

Contents

Chart A: 132-5560 Remote Speed Control Kit Parts List ..... 2

Description ..... 2

General Information ..... 2

Installation Procedure (Mounting 7C-6854 And 7C-6855 ESS Panels) ..... 2

Installation Procedure (Mounting 129-1316 And 129-1317 ESS Panels) ..... 3

Illustration 1: Film (Decal) On ESS Panel Door ..... 3

Illustration 2: Remote Speed Control On Top Of Plate Assembly ..... 3

Illustration 3: 7C-6854 And 7C-6855 ESS Panels ..... 4

Illustration 4: 129-1316 And 129-1317 ESS Panels ..... 4

Illustration 5: 130-2706 Plate Assembly ..... 5

Illustration 6: Connection Diagram ..... 6

Wires And Cables ..... 6

Chart B: ESS Connection ..... 7

System Operation And Instructions ..... 7

Signal Descriptions ..... 9

Troubleshooting ..... 9

Illustration 7: Remote Speed Control ..... 10

Illustration 8: Schematic ..... 11

Diagnostic Codes ..... 11

Functional Test ..... 13

| CHART A: 132-5560 REMOTE SPEED CONTROL KIT PARTS LIST | | |
|---|---|---|
| Part No. | Description | Qty. |
| 125-5486 | Control Group | 1 |
| 130-2706 | Plate Assembly | 1 |
| 130-2704 | Switch Assembly | 1 |
| 130-2707 | Indicator Assembly Lamp (Green) | 1 |
| 130-2708 | Indicator Assembly Lamp (Orange) | 3 |
| 130-2705 | Film (Decal) | 1 |
| 3H-3627 | Machine Screw | 2 |
| 4B-4863 | Washer | 2 |

Description

The purpose of the G3600 Engine Supervisory System (ESS) Remote Speed Control (RSC) is to provide a 4 to 20 milliamperes (mA) interface to the desired speed input of the ESS for a customer-supplied engine rpm (speed) input. The RSC monitors the Local Speed (Desired Speed Potentiometer) input and the Remote Speed (4 to 20 mA) input. (Refer to Illustration 2.)

The RSC provides outputs to inform the customer that the engine is running from the Remote Speed or Local Speed input. (Refer to Illustration 2.) The RSC also provides circuitry that will only allow switching between the inputs if the two speed inputs are within 2.5 percent of each other.

General Information

When an RSC is installed the following requirements must be met.

- The mounting, environment, power, and wire specifications must be followed as outlined in this Special Instruction.
- The connection diagrams must be adhered to.

Specifications

- Environmental

The ambient operating temperature range is from −40 to 85° C (−40 to 185° F).

The storage temperature is from −40 to 85° C (−40 to 185° F).

Power

The RSC requires 24 volts DC power (VDC) which is the same requirement as for the ESS system. The RSC can therefore be powered by the ESS system.

Maximum power dissipation is 12 watts at 24 VDC.

The relay driver outputs can drive a relay or lamp that is rated for 200 mA or less. The 130-2707 Indicator Assembly Lamp (Green) and 130-2708 Indicator Assembly Lamp (Orange) are recommended.

Installation Procedure

Mounting 7C-6854 And 7C-6855 ESS Panels

1. Install 130-2705 Film (Decal) on the ESS panel door over the current desired speed film. (Refer to Illustration 1.)

2. Cut one 12.2 mm (0.48 in) hole and four 13.2 mm (0.52 in) holes in the ESS panel door for the switch and indicator lamps. Use 130-2705 Film (Decal) as a guide. Be aware of existing wires on the back side (inside) of the door when cutting the holes.

3. Install one 130-2707 Indicator Assembly Lamp (Green), three 130-2708 Indicator Assembly Lamps (Orange), and one 130-2704 Switch Assembly in the ESS panel door. (Refer to Illustration 1.)

NOTE: The switch should be mounted so that it points toward the LOCAL active lamp (green) when the circuit is open. The switch should be mounted so that it points toward the REMOTE active lamp (orange) when the circuit is closed.

4. Remove the Desired Speed Buffer from the inside of the ESS panel. The Desired Speed Buffer is the lower control of the two on the left side of the ESS panel. (Refer to Illustration 3.) DO NOT discard the mounting screws. They will be required in Step 6. Disconnect the wires from the Desired Speed Buffer.

5. Remove the Fuel Energy Content (BTU) buffer from the ESS panel. (Refer to Illustration 3.) DO NOT discard the mounting screws. They will be required in Step 8.

6. Install 125-5486 Control Group on top of 130-2706 Plate Assembly. Use the two mounting screws from Step 4. (Refer to Illustration 5.)

7. Install 130-2706 Plate Assembly onto the side of the ESS panel using two 3H-3627 Machine Screws and two 4B-4863 Washers. (Refer to Illustration 5.)

8. Install the Fuel Energy Content (BTU) potentiometer buffer onto 130-2706 Plate Assembly. Use the two mounting screws from Step 5. (Refer to Illustration 5.)

9. Tighten all fasteners (screws) to 1.7 ± 0.3 N•m (15 ± 2 lb in). Connect the wires according to Illustration 6 and Chart B in this Special Instruction.

10. The 4 to 20 mA input on the RSC may have a different resistance than any module it replaces. The module generating the 4 to 20 mA signal may have to be adjusted to compensate for this difference.

11. Replace the Personality Module with one that has the updated Desired Speed scaling.

Installation Procedure

Mounting 129-1316 And 129-1317 ESS Panels

1. Install 130-2705 Film (Decal) on the ESS panel door over the current desired speed film. (Refer to Illustration 1.)

2. Cut one 12.2 mm (0.48 in) hole and four 13.2 mm (0.52 in) holes in the ESS panel door for the indicator lamps and switch. Use 130-2705 Film (Decal) as a guide. Be aware of existing wires on the back side (inside) of the door when cutting the holes.

3. Install one 130-2707 Indicator Assembly Lamp (Green), three 130-2708 Indicator Assembly Lamps (Orange), and one 130-2704 Switch Assembly in the ESS panel door. (Refer to Illustration 1.)

NOTE: The switch should be mounted so that it points toward the LOCAL active lamp (green) when the circuit is open. The switch should be mounted so that it points toward the REMOTE active lamp (orange) when the circuit is closed.

4. Remove the Desired Speed Buffer from the inside of the ESS panel. The Desired Speed Buffer is the upper control of the two on the left side of the ESS panel. (Refer to Illustration 4.) DO NOT discard the mounting screws. They will be required in Step 5. Disconnect the wires from the Desired Speed Buffer.

5. Install 125-5486 Control Group where the Desired Speed Buffer was removed. (Refer to Illustration 4.)

6. Tighten all fasteners (screws) to 1.7 ± 0.3 N•m (15 ± 2 lb in). Connect the wires according to Illustration 6 and Chart B in this Special Instruction.

7. The 4 to 20 mA input on the RSC may have a different resistance than any module it replaces. The module generating the 4 to 20 mA signal may have to be adjusted to compensate for this difference.

8. Replace the Personality Module with one that has the updated Desired Speed scaling.

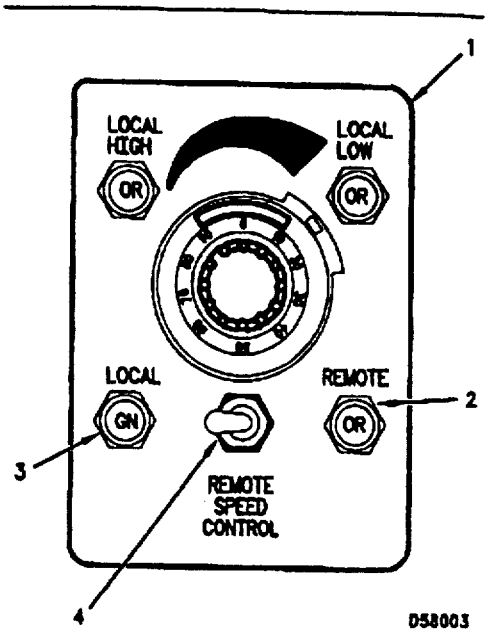

Illustration 1. Film (Decal) On ESS Panel Door: (1) 130-2705 Film (Decal). (2) 130-2708 Indicator Assembly Lamp (Orange). (3) 130-2707 Indicator Assembly Lamp (Green). (4) 130-2704 Switch Assembly.

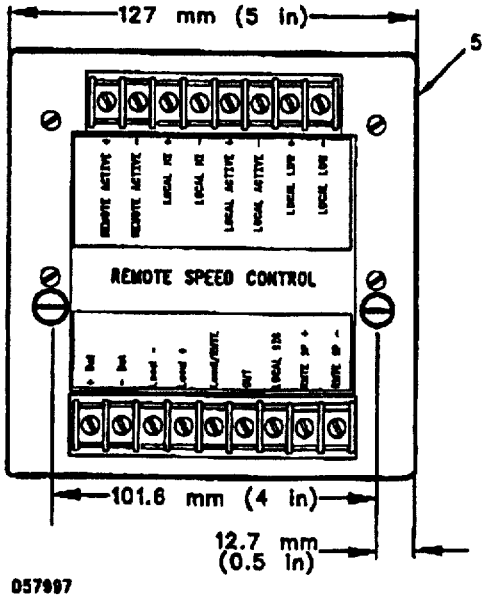

Illustration 2. Remote Speed Control On Top Of Plate Assembly: (5) 125-5486 Control Group.

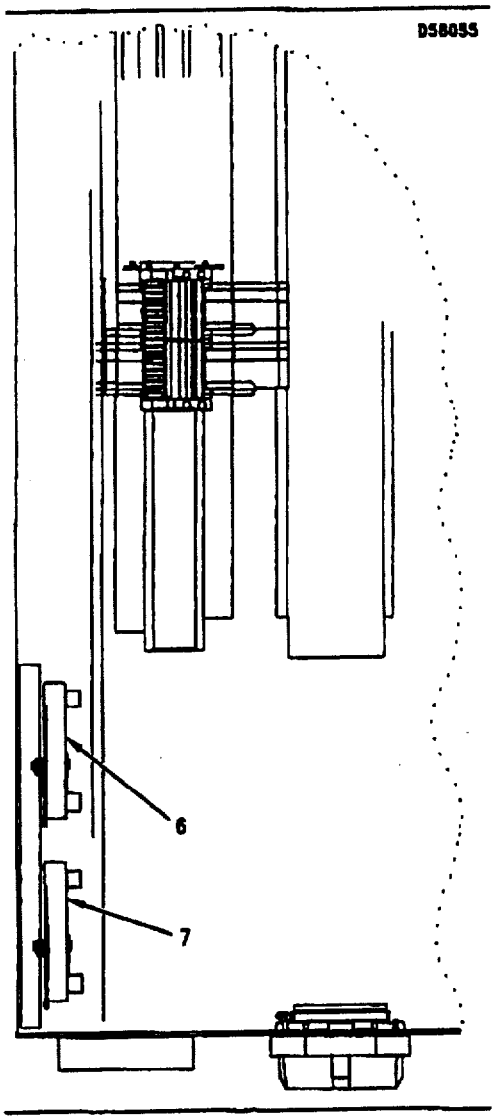
Illustration 3. 7C-6854 And 7C-6855 ESS Panels: (6) Fuel Energy Content (BTU) Buffer. (7) Desired Speed Buffer.
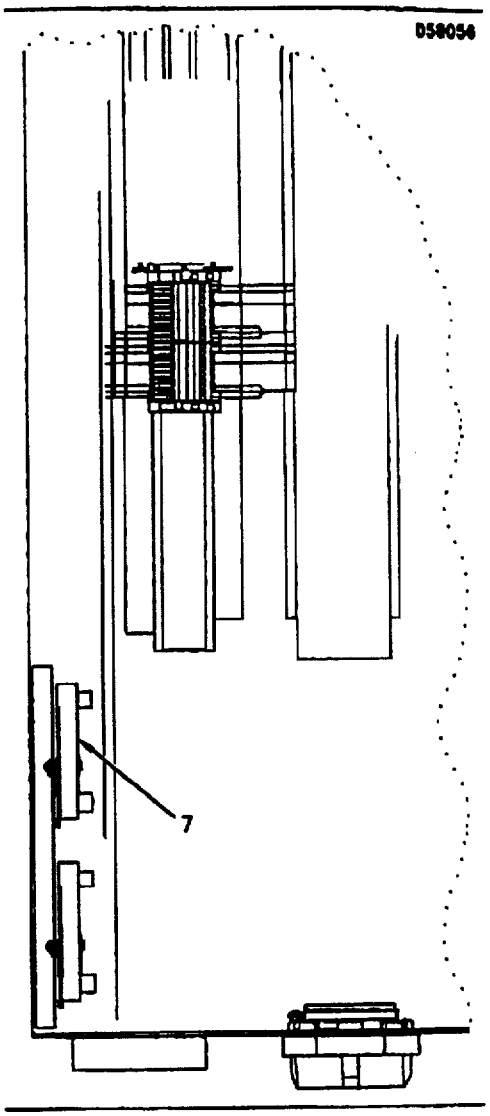
Illustration 4. 129-1316 And 129-1317 ESS Panels: (7) Desired Speed Buffer.

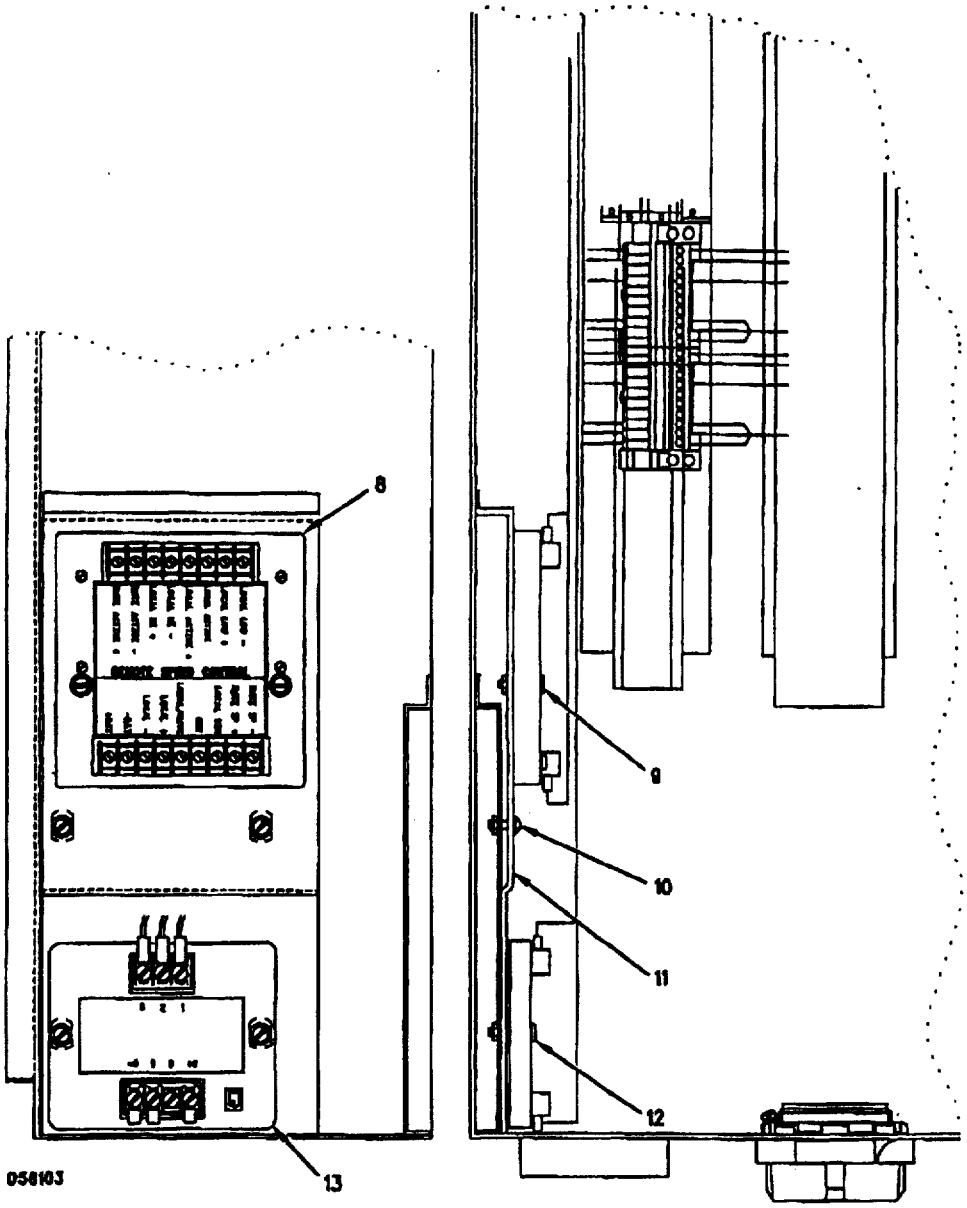
Illustration 5. 130-2706 Plate Assembly: (8) 125-5486 Control Group. (9) Existing screws. (10) 3H-3627 Machine Screw and 4B-4863 Washer. (11) 130-2706 Plate Assembly. (12) Existing screws. (13) Fuel energy content (BTU) buffer.

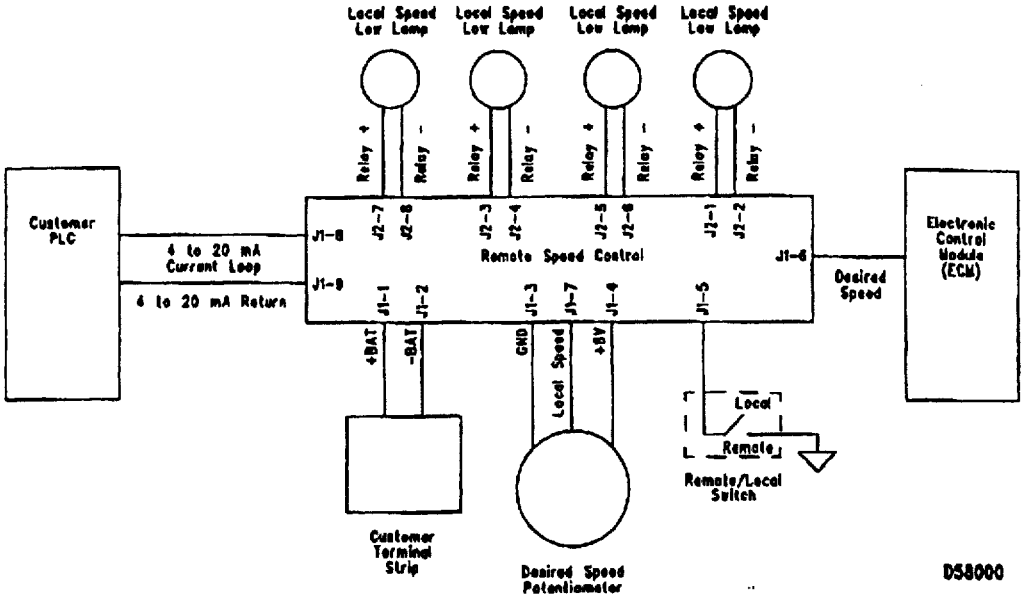
Illustration 6: Connection Diagram.
Wires And Cables
- The wires connected to the Remote Speed Control must be at least 18 AWG.
No terminations or splices are allowed on any of these wires, except as noted in the connection diagrams.

| CHART B: ESS CONNECTION | | |
|---|---|---|
| RSC Terminal | Label | ESS Connection |
| J1-1 | + BAT | + BAT Connection On Customer Terminal Strip |
| J1-2 | – BAT | – BAT Connection On Customer Terminal Strip |
| J1-3 | LOCAL – | Negative Terminal Of Desired Speed Potentiometer (Black Wire) |
| J1-4 | LOCAL + | Positive Terminal Of Desired Speed Potentiometer (Orange Wire) |
| J1-5 | LOCAL/RMTE | Local/Remote Switch (Other Connection Of Switch Is Wired To GND) |
| J1-6 | OUT | Engine Control Desired Speed Input (Yellow Wire) |
| J1-7 | LOCAL SIG | Signal Terminal On Desired Speed Potentiometer (Green Wire) |
| J1-8 | RMTE SP + | 4 to 20 mA Output of PLC |
| J1-9 | RMTE SP – | 4 to 20 mA Return of PLC |
| J2-1 | RMTE ACTIVE + | Remote Active Lamp[1] |
| J2-2 | RMTE ACTIVE – | Remote Active Lamp Return |
| J2-3 | LOCAL HI + | Local Speed High Lamp[1] |
| J2-4 | LOCAL HI – | Local Speed High Lamp Return |
| J2-5 | LOCAL ACTIVE + | Local Speed Active Lamp[1] |
| J2-6 | LOCAL ACTIVE – | Local Speed Active Lamp Return |
| J2-7 | LOCAL LOW + | Local Speed Low Lamp[1] |
| J2-8 | LOCAL LOW – | Local Speed Low Lamp Return |

[1] The output can drive lamps supplied with RSC Module or they can drive relays (3N-5714 Relay Assembly is recommended) that draw 200 mA or less. The relay coil can be connected between the driver output and returned in the same manner as the lamp.

System Operation And Instructions

Switch Positions

When the selector switch is in the LOCAL position, engine rpm (speed) is adjusted with the Desired Speed Potentiometer on the front of the ESS panel. The Local Speed Active output on the RSC is energized to indicate engine rpm is being locally controlled. This mode is primarily used for initial engine starting, shutdown, and maintenance operations.

When the selector switch is in the REMOTE position, engine rpm (speed) is adjusted by an external 4 to 20 mA signal. The Remote Speed Active output is energized to indicate the engine is being controlled from a remote source.

The mode (Local or Remote) is controlled by a selector switch on the front of the ESS panel. Switching modes is only allowed when the engine rpm differential between the Local setting and the Remote setting is less than a preset tolerance (within 2.5 percent). If the selector switch is moved when the rpm differential is less than 2.5 percent, nothing will happen until the differential is less than the tolerance.

Status Lamps

There are two status indicators to help with switching modes. The indicator lamps are Local Speed Low and Local Speed High.

The Local Speed Low output is energized if the local speed is too far below the remote speed to facilitate switching. The Local Speed High output is energized if the local speed is too far above the remote speed to facilitate switching.

If both outputs are not energized, the two speeds are within switching tolerance and the engine can be controlled from the selected engine rpm (speed) input.

The typical Engine Mode Switching is described below.

Engine Start Up – The selector switch is in the LOCAL position. The engine is started and site conditions are stabilized. The local speed is adjusted so that it is within tolerance of the remote speed setting. The selector switch is moved to the REMOTE position. Engine speed now follows the remote signal.

Maintenance/Shutdown – The local speed setting is adjusted to within tolerance of the remote setting. The selector switch is moved to the LOCAL position. Engine rpm is adjusted as necessary for maintenance or the engine is shut down. The selector switch is then placed in the REMOTE position to allow remote speed control as described in the Engine Start Up topic.

Operation With Selector Switch In LOCAL Position

- The desired speed output signal follows the local engine rpm (speed) input.
- The Local Mode Active output is energized.
- The Remote Mode Active output is not energized.
- The Local Speed Low output is energized if the local engine rpm (speed) setting is too far below the remote engine rpm (speed) setting.
- The Local Speed High output is energized if the local engine rpm (speed) setting is too far above the remote engine rpm (speed) setting.

Operation With Selector Switch In REMOTE Position

- The Desired Speed Output signal follows the remote engine rpm (speed) input.
- The Local Mode Active output is not energized.
- The Remote Mode Active output is energized.
- The Local Speed Low output is energized if the local engine rpm (speed) setting is too far below the remote engine rpm (speed) setting.
- The Local Speed High output is energized if the local engine rpm (speed) setting is too far above the remote engine rpm (speed) setting.

Switching From LOCAL Position To REMOTE Position

All output settings are initially as described in the Operation With Selector Switch In Local Position topic. The selector switch is then moved from LOCAL position to REMOTE position. The action that occurs next depends on how far the local and remote engine rpm (speed) input settings are set apart.

Example 1 – The remote engine rpm (speed) setting is close (within tolerance) to the local engine rpm (speed) setting. Therefore, the control of engine rpm immediately transfers to the remote input setting.

Example 2 – The remote engine rpm (speed) setting is not close (out of tolerance) to the local engine rpm (speed) setting. Therefore, the control of engine rpm continues to follow the local engine rpm setting until the local and/or remote setting is moved to within the preset switching tolerance. The local and/or remote setting may be performed manually or by the Customer Programmable Logic Controller (PLC). It is only then that the control of engine rpm will transfer to the remote engine rpm setting.

Switching From REMOTE Position To LOCAL Position

All output settings are initially as described in the Operation In Remote Mode topic. The selector switch is then moved from REMOTE position to LOCAL position. The action that occurs next depends on how far apart the local and remote engine rpm (speed) settings are from one another.

Example 1 – The remote engine rpm (speed) setting is close (within tolerance) to the local engine rpm (speed) setting. Therefore, the control of engine rpm immediately transfers to the local engine rpm setting.

Example 2 – The remote engine rpm (speed) setting is not close (out of tolerance) to the local engine rpm (speed) setting. Therefore, the control of engine rpm continues to follow the remote engine rpm setting until the local and/or remote engine rpm setting is moved to within the preset switching tolerance. The local and/or remote setting may be performed manually or by the Customer PLC. It is only then that the control of the engine rpm will transfer to the local engine rpm setting.

Signal Descriptions

J1 – Terminal 1 (+) BAT is power to the ESS panel or desired speed potentiometer. It should maintain 24 VDC.

J1 – Terminal 2 (–) BAT is ground (GND) to the ESS panel or desired speed potentiometer. It should maintain (–) Battery potential.

J1 – Terminal 3 LOCAL (–) is ground (GND) to the desired speed potentiometer. It should maintain (–) Battery Potential.

J1 – Terminal 4 LOCAL (+) is the power to the desired speed potentiometer. It should read 8 VDC when the RSC is powered up.

J1 – Terminal 5 LOCAL/RMTE is a switch input. If the switch is in the "LOCAL" position, the voltage on this terminal should be between 10 VDC and 14 VDC. If the switch is in the "REMOTE" position, the voltage on the terminal should be 0 VDC.

J1 – Terminal 6 OUT is a 500 Hz PWM output signal. The voltage lead should be less than 1.5 VDC when low and greater than 100 VDC when high.

J1 – Terminal 7 LOCAL SIG is the signal from the desired speed potentiometer. It will be a value between 8 VDC and 0 VDC depending on the position of the potentiometer.

J1 – Terminal 8 RMTE SP (+) is the 4 to 20 mA input from the remote PLC. The voltage on this terminal should range between –200 VDC and +200 VDC. The current should range between 4 and 20 mA into the terminal.

J1 – Terminal 9 RMTE SP (–) is the return from the PLC. The voltage on this terminal should range between –200 VDC and +200 VDC. The current through this terminal should be the same as on the RMTE SP (+) terminal. When the module is attached to the current loop, the voltage at this terminal should be 5.0 to 7.5 VDC lower than the voltage on the RMTE SP (+) terminal.

J2 – Terminal 1 RMTE ACTIVE (+) is the terminal whose voltage should be the same as the (+) BAT voltage.

NOTE: This terminal has no internal connection to the module. It is wired to the (+) BAT through an external harness.

J2 – Terminal 2 RMTE ACTIVE (–) is the terminal whose voltage should be the same as the (+) BAT voltage when the Remote Active lamp is OFF. The voltage should be 0.5 to 2.0 VDC when the lamp is ON.

J2 – Terminal 3 LOCAL HI (+) is the terminal whose voltage should be the same as the (+) BAT voltage.

NOTE: This terminal has no internal connection to the module. It is wired to the (+) BAT through an external harness.

J2 – Terminal 4 LOCAL HI (–) is the terminal whose voltage should be the same as the (+) BAT voltage when the LOCAL HI lamp is OFF. The voltage should be 0.5 to 2.0 VDC when the lamp is ON.

J2 – Terminal 5 LOCAL ACTIVE (+) is the terminal whose voltage should be the same as the (+) BAT voltage.

NOTE: This terminal has no internal connection to the module. It is wired to the (+) BAT through an external harness.

J2 – Terminal 6 LOCAL ACTIVE (–) is the terminal whose voltage should be the same as the (+) BAT voltage when the Local Active lamp is OFF. The voltage should be 0.5 to 2.0 VDC when the lamp is ON.

J2 – Terminal 7 LOCAL LOW (+) is the terminal whose voltage should be the same as the (+) BAT voltage.

NOTE: This terminal has no internal connection to the module. It is wired to the (+) BAT through an external harness.

J2 – Terminal 8 LOCAL LOW (–) is the terminal whose voltage should be the same as the (+) BAT voltage when the Local Low lamp is OFF. The voltage should be 0.5 to 2.0 VDC when the lamp is ON.

Troubleshooting

System Operation

The Electronic Control Module (ECM) monitors the desired speed input to determine the speed at which to govern the engine.

The desired speed signal may be provided by the Desired Speed Potentiometer and Remote Speed Control located on the ESS panel. It also may be provided by one of several remote-mounted modules that can be connected through the Remote Speed Control. (It is also possible that it is provided by components other than Caterpillar components.)

In Generator Set applications, the control system does not require the desired speed input to the present except when the engine is generating power. (This is determined from measured load and/or parallel indication.)

It is normal for some external desired speed sources (particularly the loadshare module) to not provide a desired speed signal until the generator is producing power (voltage). Under these conditions, the ECM uses a Default Desired Speed.

The desired speed input (DRPM) can be read from the ECM Display Status screen.

Sensor (Potentiometer) Signals

Sensor Supply – The desired speed input is a linear pulse width modulated (PWM) voltage signal corresponding to the user input of present desired speed. The desired speed signal is generated from the Remote Speed Control which is powered from a battery source.

Output Signal – The Remote Speed Control outputs a PWM signal to the ECM. The signal level varies with the desired speed. Minimum expected input from the buffer is approximately 8 percent PWM and maximum expected PWM is approximately 92 percent. The failure (diagnostic) is detected on complete loss of the PWM signal. The valid signal range is approximately 5 to 95 percent duty cycle.

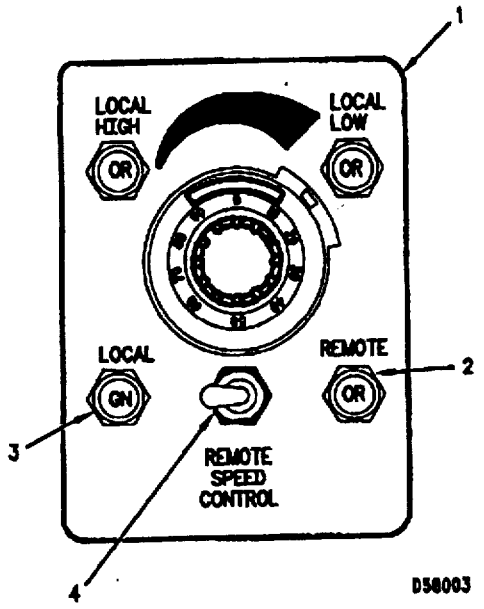

Illustration 7. Remote Speed Control Display: (1) 130-2705 Film (Decal). (2) 130-2708 Indicator Assembly Lamp (Orange). (3) 130-2707 Indicator Assembly Lamp (Green). (4) 130-2704 Switch Assembly.

Control Diagnostics

524–12 Desired Speed Input Alarm indicates that the engine does not have a valid desired speed and is running at the default rated speed or default desired speed. This condition may be normal under some circumstances (such as a loadshare interface and manually energized generator exciter). This condition is permitted provided that the load on the engine has not exceeded 50 percent. This alarm will only occur on generator set application engines.

524–12 Desired Speed Input Shutdown indicates that the engine does not have a valid desired speed and is not an acceptable duty cycle or frequency or there is no desired speed signal. This condition may be caused by a faulty Desired Speed Potentiometer or intermittent problem.

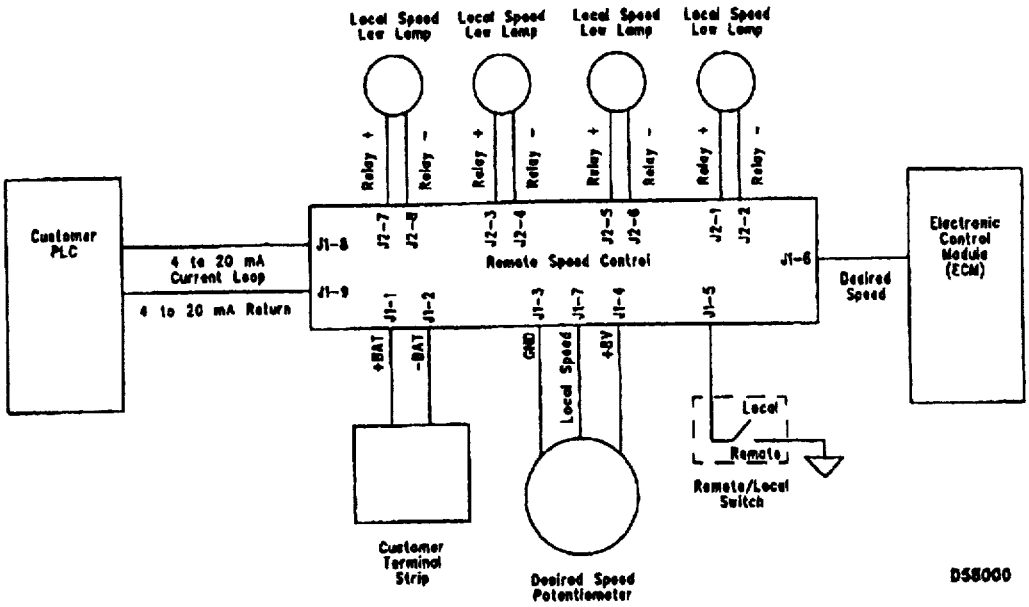

Illustration 8: Schematic.

Diagnostic Codes

| 524-12 (NOT FLASHING) DESIRED SPEED INPUT ALARM | | |
|---|---|---|
| **System Response** | **Conditions Which Generate This Code** | **Troubleshooting** |
| If the engine is running, it will continue to run. The control system will attempt to operate the engine using the last valid data received.<br><br>The diagnostic code will remain displayed until the code is cleared by toggling the Display Select Switch or the alarm will be cancelled by the following code.<br><br>524-12, Desired Speed Input Shutdown. | • The engine is set to GEN SET mode,<br><br>• the engine is running,<br><br>• the engine speed is set to RATED for 13 seconds while indicated engine load is less than 50 percent, and<br><br>• No PWM signal is present.<br><br>Probable Causes For This Diagnostic:<br><br>• Intermittent problem with the potentiometer or wiring.<br><br>• The generator exciter is not energized or is slow to energize.<br><br>• The loadshare module (if equipped) is malfunctioning.<br><br>• There is a wiring problem between the loadshare module and the ESS system.<br><br>• The engine is set to GEN SET mode. | The Desired Speed Input may be provided in several ways to the ECM. Before beginning troubleshooting, determine the type of Desired Speed Input provided. Determine which of these conditions is the case before proceeding.<br><br>If an external Desired Speed Input is used (assumed to be loadshare module or equivalent), then inspect the external input as the cause for a faulty desired speed signal.<br><br>If the ESS Panel-mounted potentiometer and buffer are used, proceed with Functional Test. |

| 524-12 (FLASHING) DESIRED SPEED INPUT SHUTDOWN | | |
|---|---|---|
| **System Response** | **Conditions Which Generate This Code** | **Troubleshooting** |
| If the engine is running, the engine will shutdown. The diagnostic code will remain displayed. The engine will be prevented from restarting until the diagnostic code is cleared by toggling the Display Select Switch.<br><br>A "RST REQD" diagnostic will also be present on the ECM to indicate the system must be reset before restarting the engine. Momentarily turning the Mode Control Switch to the OFF/RESET position will reset the system. | All Applications:<br><br>The engine is running.<br><br>• the desired speed signal is present but is not an acceptable duty cycle or frequency for 0.3 seconds, and<br><br>• No Desired Speed PWM signal has been present for 0.2 seconds.<br><br>Generator Set Applications:<br><br>Detection Method 1<br>(No Signal at Load):<br><br>• No Desired Speed PWM signal to indicate desired speed has been present for 0.3 seconds, and<br><br>• Indicated engine load is greater than 50 percent, and<br><br>• Rated speed operation has been selected for more than 13 seconds.<br><br>Detection Method 2<br>(No Signal at On GRID):<br><br>• No Desired Speed PWM signal to indicate desired speed has been present for 0.3 seconds, and<br><br>• The "parallel" input indicates paralleled to utility.<br><br>Industrial Applications:<br><br>• No Desired Speed PWM signal is present for 0.5 seconds.<br><br>Probable Causes For This Diagnostic<br><br>• Faulty Desired Speed Potentiometer or intermittent problem with the potentiometer or wiring.<br><br>• Problem in loadshare unit or switchgear, if equipped. (Generator Set Applications) | The Desired Speed Input may be provided in several ways to the ECM. This diagnostic code acts differently depending on the engine application (Industrial or Generator Set). Before beginning troubleshooting, determine the type of Desired Speed Input provided and the engine application.<br><br>If an external 4 to 20 mA desired speed signal is supplied to the Remote Speed Control, proceed to Step 6.<br><br>If the ESS Panel-mounted potentiometer and Remote Speed Control are used, proceed to Step 2.<br><br>Proceed with the Functional Test. |

| NO DIAGNOSTIC CODE: RSC WILL NOT SWITCH MODES PROPERLY OR LAMPS DO NOT FUNCTION CORRECTLY | | |
|---|---|---|
| **System Response** | **Conditions Which Generate This Code** | **Troubleshooting** |
| Do not attempt to operate the engine unless the DRPM on the Engine Control Display can be controlled from either the Desired Speed Potentiometer or the external 4 to 20 mA source. | • Remote/Local Switch wired improperly.<br><br>• Faulty Remote/Local Switch.<br><br>• Lamps burned out.<br><br>• Lamps wired improperly.<br><br>• Power not wired to RSC or Lamps.<br><br>• Faulty RSC. | All wiring and lamps must be inspected. It may appear that the RSC is not switching properly because the lamps are burned out, connected improperly, or wired improperly. Ensure that all lamps are connected to (+) Battery terminal.<br><br>If no problem is found with the lamps or wiring, proceed to Step 9. |

Functional Test

Step 1: Check For Connector Damage

1. Remove power from the control system. Turn the Mode Control Switch (MCS) to the OFF/RESET position. Open the fuse breaker in the ESS Panel.

2. Check the Electronic Control Module (ECM) Connector, Terminal Strip Connections in the ESS Panel, the desired speed signal, and the Desired Speed Potentiometer for corrosion or mechanical failure. (Refer to Section 2: P-002: Inspecting Electrical Connectors Of The G3600 Engine Troubleshooting manual for details.)

3. Install the fuse in the ESS Panel.

4. Check the harness and wiring for abrasion and pinch points from the sensor back to the ECM.

NOTE: All connectors/pins/sockets should be completely mated/inserted and the harness/wiring should be free of corrosion, abrasion, or pinch points.

- If OK and the connectors are in good condition, proceed to Step 2.

- If not OK, repair or replace the faulty connector. STOP.

Step 2: Check For Power To The Remote Speed Control

1. Apply power to the ESS system. Turn the Mode Control Switch (MCS) to the STOP position.

2. Measure the voltage between (+) BAT and (−) BAT terminals on the Remote Speed Control.

NOTE: The voltage should be 24 ± 4 VDC.

- If OK and all voltages are within tolerance, proceed to Step 3.

- If NOT OK and if the voltage is 0 VDC, the problem is in the power wiring. Repair the wiring. STOP.

- If NOT OK and if the voltage is outside the indicated range or is unstable, there is a problem with the power supply to the ESS panel. Repair the power supply. STOP.

Step 3: Check For Proper Supply Voltage

1. Adjust the Desired Speed Potentiometer to mid-range position.

2. Apply power to the ESS system. Turn the Mode Control Switch (MCS) to the STOP position.

3. Place the Remote Speed Control Switch in the LOCAL mode position.

4. Measure the voltage between J1-4 LOCAL (+) and J1-3 LOCAL (−) on the Remote Speed Control.

NOTE: The voltage measurements should be 8.0 ± 0.5 VDC.

- If OK and the voltage is within the tolerance, proceed to Step 4.

- IF NOT OK and the voltage is less than 7.5 VDC or more than 8.5 VDC, the problem is either in the wiring or a faulty Remote Speed Control. Check the wiring. If OK, replace the Remote Speed Control. STOP.

Step 4: Check For Power To The Potentiometer

1. Apply power to the ESS system. Turn the Mode Control Switch (MCS) to the STOP position.

2. Place the Remote Speed Control Switch in the LOCAL mode position.

3. Measure the voltage between J1-7 LOCAL SIG and J1-3 LOCAL (−) (GND) on the Remote Speed Control Switch.

4. Adjust the Desired Speed Potentiometer from lowest position to highest position, then back to lowest position.

NOTE: The voltage should follow the potentiometer reading from 0 volts to 8 volts and back to 0 volts.

- If OK and the voltage follows the potentiometer position, proceed to Step 5.

- If NOT OK and the voltage does not move (parallel) with potentiometer position, check the wiring and the potentiometer. Repair as required. STOP.

Step 5: Check The Desired Speed PWM Signal

1. Apply power to the ESS system. Turn the Mode Control Switch (MCS) to the STOP position.

2. Place the Remote Speed Control Switch in the LOCAL mode position.

3. Use an oscilloscope, multimeter, or voltmeter (with PWM function) to measure the PWM Signal at the Remote Speed Control Switch from J1-6 OUT to J1-2 (−) BAT.

4. Adjust the Desired Speed Potentiometer from lowest position to highest position, then back to lowest position.

NOTE: The voltage should follow the potentiometer reading from 0 to 100 percent, then back to 0 percent with a frequency of 300 to 900 Hz.

• If OK, proceed to Step 8.

• If NOT OK and the PWM signal does not move (parallel) with the potentiometer position or the values exceed the valid ranges, check the wiring and/or replace the Remote Speed Control Module. STOP.

Step 6: Check The Signal (Remote Mode)

1. Reset all diagnostic codes. Turn the Mode Control Switch (MCS) to the OFF/RESET position and then back to the STOP position.

2. Turn the Mode Control Switch (MCS) to the START position. Start the engine and set to rated speed. Activate generator (if equipped) but do not apply load or parallel with utility.

3. Place the Remote Speed Control Switch in the REMOTE mode position.

4. Measure the PWM signal (using multimeter or voltmeter with PWM or oscilloscope) in the ESS panel at the terminals nearest to the ECM.

NOTE: The expected PWM signal is between 5 and 95 percent.

If OK and the PWM signal is steady, the PWM signal is in range (greater than 5 percent and less than 95 percent) and the frequency steady and in range between 500 and 1000 Hz), proceed to Step 8.

If NOT OK and the PWM signal is not steady, the PWM signal is out of range (less than 5 percent or greater than 95 percent), and the frequency is unsteady or out of range (less than 500 Hz or greater than 1000 Hz), proceed to Step 7.

If NOT OK and the Remote Speed Control Switch will not switch to REMOTE mode, proceed to Step 9.

Step 7: Check For Erratic Or Missing Speed Signal

1. With engine running at rated speed, measure the current into J1-8 RMTE SP (+) of the Remote Speed Signal.

NOTE: Current should range between 4 and 20 mA and remain steady.

• If OK and the 4 to 20 mA signal is in range and steady, proceed to Step 8.

• If NOT OK and the 4 to 20 mA signal is erratic, troubleshoot the cause of the erratic signal in the remote signal source. STOP.

• If NOT OK and the 4 to 20 mA signal is missing or out of range (greater than 20 mA or less than 4 mA), troubleshoot the source of the missing or out of range signal. STOP.

Step 8: Verify That The Diagnostic Code Is Present

1. Reset all diagnostic codes. Turn the Mode Control Switch (MCS) to the OFF/RESET position and then back to the STOP position.

NOTE: The engine should be started to verify if diagnostic codes reoccur.

2. Restart the engine to verify if the 524 Diagnostic Code reoccurs.

3. Check the wiring from the remote equipment to the ECM on wire M103 (Signal). Look for shorts to any other wiring (PWM specifically). The PWM signal is provided to the ECM from the Desired Speed input on the user interface terminal (lower right side of the ESS panel), and wire M103 (Signal) to the ECM connector J3 pin-17. The signal must be referenced to ground [(−) BAT] terminal.

• If OK and the diagnostic code does not return, STOP.

• If NOT OK and the diagnostic code returns, the problem is intermittent or may be caused from a noisy signal. STOP.

Step 9: Check The Power Up Sequence

1. Remove power from the ESS system. Turn the Mode Control Switch (MCS) to the OFF/RESET position.

2. Place the Local/Remote Switch in the LOCAL mode position.

3. Apply power to the ESS system. Turn the Mode Control Switch (MCS) to the STOP position.

- If OK and the RSC powers up with the Local Active Lamp ON and the Remote Active Lamp OFF, proceed to Step 10.

- If NOT OK and the RSC powers up with the Remote Active Lamp ON and the Local Active Lamp OFF, troubleshoot the wiring to the Local/Remote Switch. The switch may have to be reoriented. STOP.

- If NOT OK and the RSC powers up with both Local Active and Remote Active Lamps OFF or ON, troubleshoot the wiring to the lamps. Troubleshoot the power wiring to the RSC. STOP.

Step 10: Check The REMOTE Mode Switching Function

1. Adjust the Desired Speed Potentiometer until the Local Low Lamp and Local High Lamp are OFF.

2. Place the Local/Remote Switch to REMOTE mode position.

- If OK and both lamps turn OFF and the module switches modes to REMOTE, proceed to Step 11.

- If NOT OK and the lamps will not turn OFF, troubleshoot the lamp wiring. Repair as required. STOP.

- If NOT OK and the lamps are intermittently turning ON and OFF, troubleshoot the desired speed signal. Refer to the G3600 Engine Troubleshooting, SENR6510. STOP.

- If NOT OK and the lamps go out but the module will not switch to remote mode, check the lamp wiring, check the switch wiring, and check the switch operation. Repair as needed. STOP.

Step 11: Check The LOCAL Mode Switching Function

1. Switch the Local/Remote Switch back to LOCAL mode

- If OK and the module switches back to LOCAL mode and all the lamps function correctly, then the module is working. STOP.

- If NOT OK and the diagnostic code returns, the problem is intermittent or may be caused from a noisy signal. STOP.